US011079188B2

(12) United States Patent
Guerini

(10) Patent No.: US 11,079,188 B2
(45) Date of Patent: Aug. 3, 2021

(54) FIREARM

(71) Applicant: CAESAR GUERINI S.R.L., Brescia (IT)

(72) Inventor: Antonio Guerini, Brescia (IT)

(73) Assignee: CAESAR GUERINI S.R.L., Brescia (IT)

( * ) Notice: Subject to any disclaimer, the term of this patent is extended or adjusted under 35 U.S.C. 154(b) by 0 days.

(21) Appl. No.: 16/767,033

(22) PCT Filed: Sep. 26, 2018

(86) PCT No.: PCT/IB2018/057456

§ 371 (c)(1),
(2) Date: May 26, 2020

(87) PCT Pub. No.: WO2019/130102

PCT Pub. Date: Jul. 4, 2019

(65) Prior Publication Data

US 2021/0033361 A1 Feb. 4, 2021

(30) Foreign Application Priority Data

Dec. 29, 2017 (IT) ..... 102017000151130

(51) Int. Cl.
*F41A 3/58* (2006.01)

(52) U.S. Cl.
CPC ..... *F41A 3/58* (2013.01)

(58) Field of Classification Search
CPC ..... F41A 3/58
USPC ..... 42/75.04
See application file for complete search history.

(56) References Cited

U.S. PATENT DOCUMENTS 289,273 A 11/1883 Kirkwood
2,683,947 A * 7/1954 Holt ..... F41A 19/54 42/42.02
4,964,232 A * 10/1990 Mainland ..... F41A 3/58 42/44

(Continued)

FOREIGN PATENT DOCUMENTS

DE 202016100700 U1 6/2017
EP 1645831 A1 4/2006

*Primary Examiner* — Samir Abdosh
(74) *Attorney, Agent, or Firm* — James S. Keddie; Bozicevic, Field & Francis LLP

(57) ABSTRACT

A firearm (1) comprising a firearm frame (2) which delimits at least one first friction surface (6, 6'); one barrel (4, 4'), mounted to said frame (2) in a rotatable manner (A1) between opening and closing configurations and comprising an abutment appendix (8); and an adjustment device (10). Such a device comprises: 1) a second friction surface (12) placed in a sliding contact with the first friction surface (6, 6') to oppose a resistance to the rotation of the barrel (4, 4') between the configurations; ii) a contact surface (14) with the abutment appendix (8); iii) an adjustment member (16), longitudinally movable (LI, L2) for modifying a relative distance between the second friction surface (12) and the contact surface (14), thereby adjusting the sliding friction between said friction surfaces (6, 6', 12); and iv) a maneuvering element (18) rotatable in discrete adjustment positions, interacting with the adjustment member (16) to move it by a constant pitch at each angularly adjacent adjustment position.

13 Claims, 5 Drawing Sheets

(56) References Cited

U.S. PATENT DOCUMENTS

| | | | | |
|---|---|---|---|---|
| 5,225,610 | A * | 7/1993 | Uria | F41A 11/02 42/40 |
| 5,933,998 | A * | 8/1999 | Plebani | F41A 3/58 42/75.04 |
| 6,705,035 | B2 * | 3/2004 | Gussalli Beretta | F41A 3/58 42/40 |
| 8,839,542 | B2 * | 9/2014 | Dubois | F41A 11/00 42/16 |
| 2003/0089015 | A1 * | 5/2003 | Beretta | F41A 3/58 42/40 |

* cited by examiner

FIREARM

CROSS-REFERENCE TO RELATED APPLICATIONS

This application is a § 371 national phase of International Application No. PCT/IB2018/057456, filed on Sep. 26, 2018, which claims the benefit of Italian Application No. 102017000151130, filed on Dec. 29, 2017, which applications are incorporated by reference herein.

The present invention relates to a firearm provided with a device for adjusting the resistance to rotation of a barrel mounted rotatable to the frame.

It is known that, by factory, the rotation of the barrel of a break action rifle is adjusted according to a predefined setting, which usually does not take into account the features of the end user.

More precisely, the most forced users interpret an excessive ease of rotation of the barrels with respect to the frame as a manufacturing defect. On the contrary, users with less force in their arms (for example, women, without necessarily being a matter of gender), perceive an excessive resistance to rotation as a defect, or anyway as an undesirable feature in the repeated cycle of charge, firing, extracting ammunition from, and loading new ammunition into, the combustion chambers.

The present invention falls within this context, aiming to provide a firearm with an adjustment device capable of determining the hardness, or on the contrary the yielding, with which a barrel can be rotated more than its own frame, such adjustment being advantageously possible at any time, even by the end user of the firearm.

This object is achieved by a firearm according to claim 1, and by an adjustment device. The dependent claims describe preferred embodiment variants.

The object of the present invention will now be described in detail, with the aid of the accompanying drawings, in which:

FIG. 2 is an enlargement of the area II shown in FIG. 1;

Figure 1:
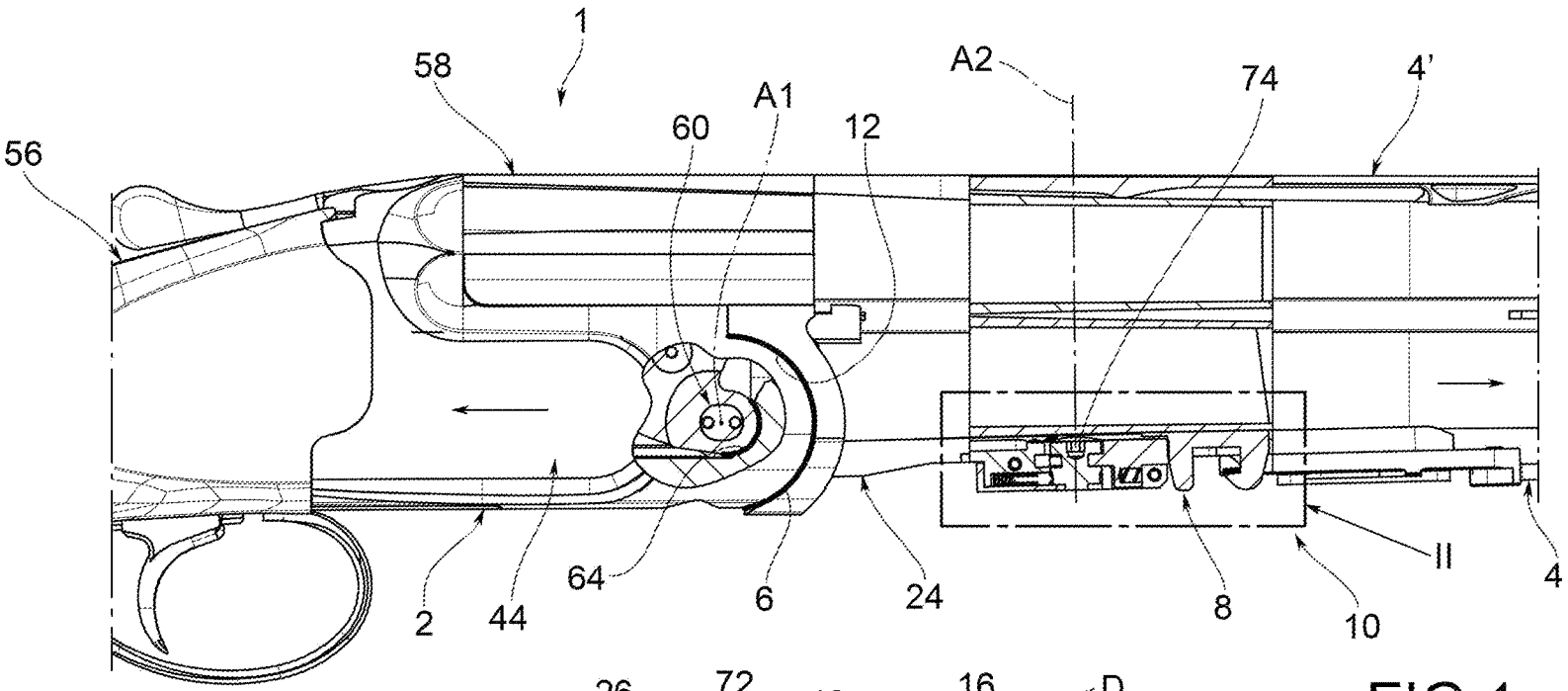
FIGS. 1 and 2 show two longitudinal lateral section views, respectively, through a firearm object of the present invention, according to a possible embodiment, where
Figure 2:
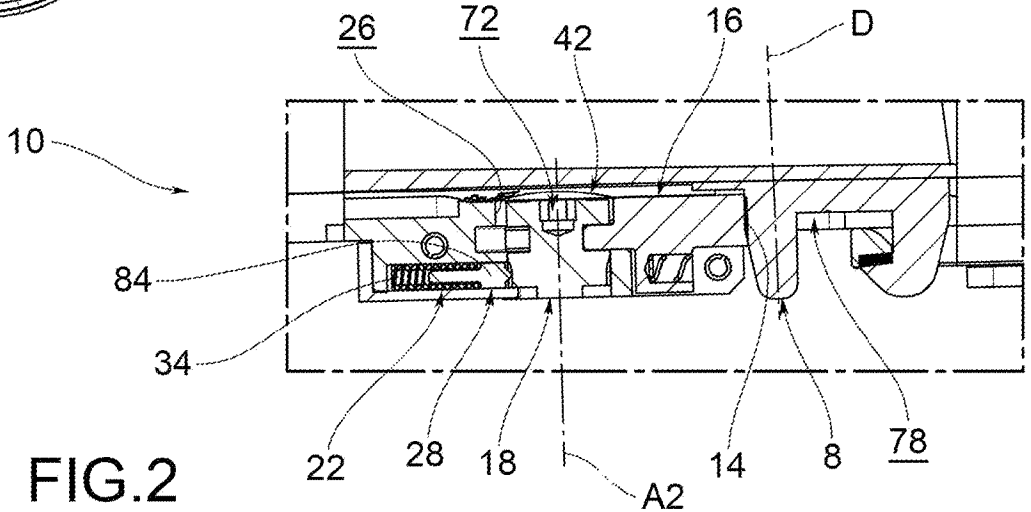
Figure 3A:
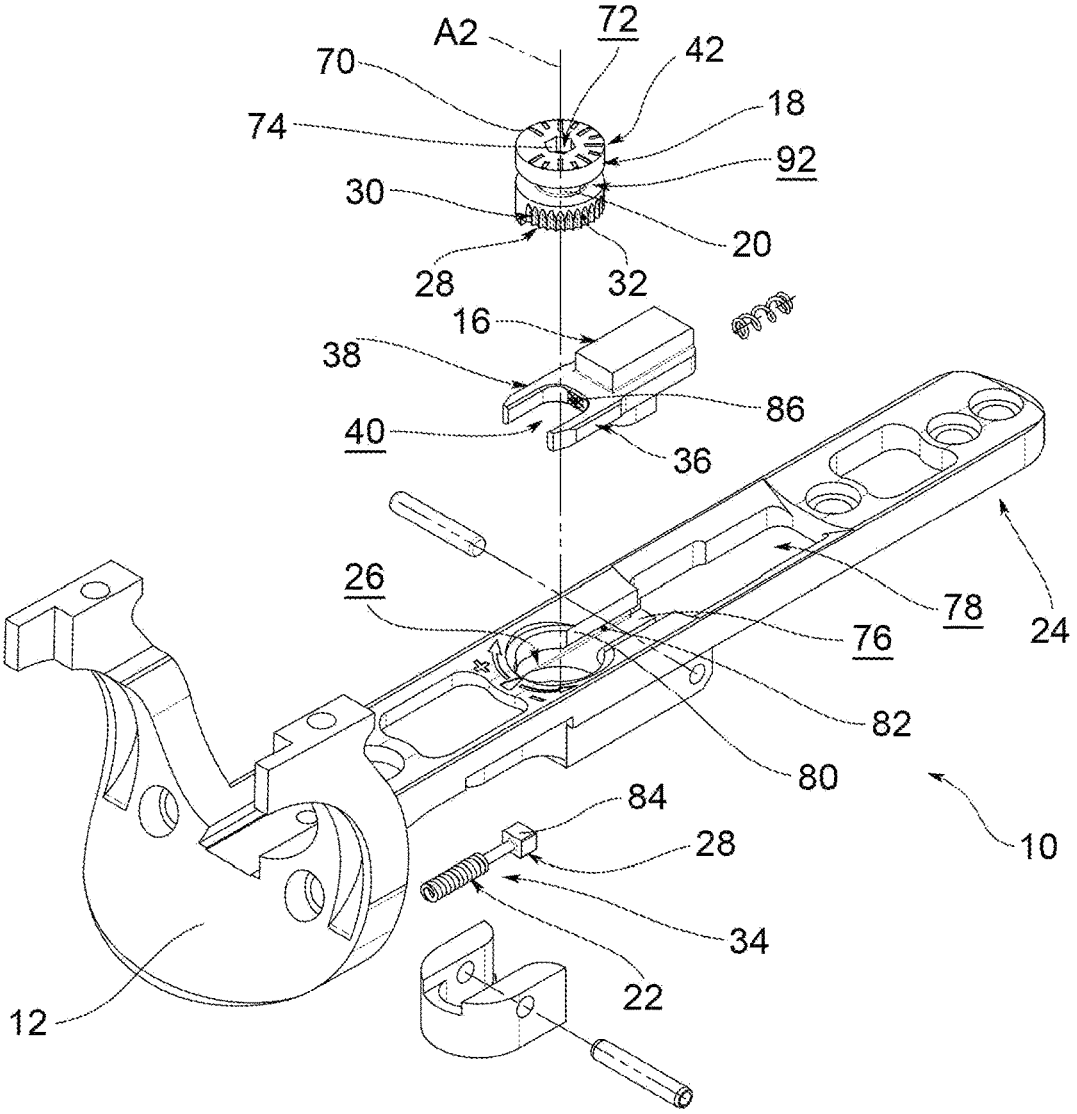
FIG. 3A is a view in separate parts of the adjustment device, object of the present invention, according to a variant.
Figure 3B:
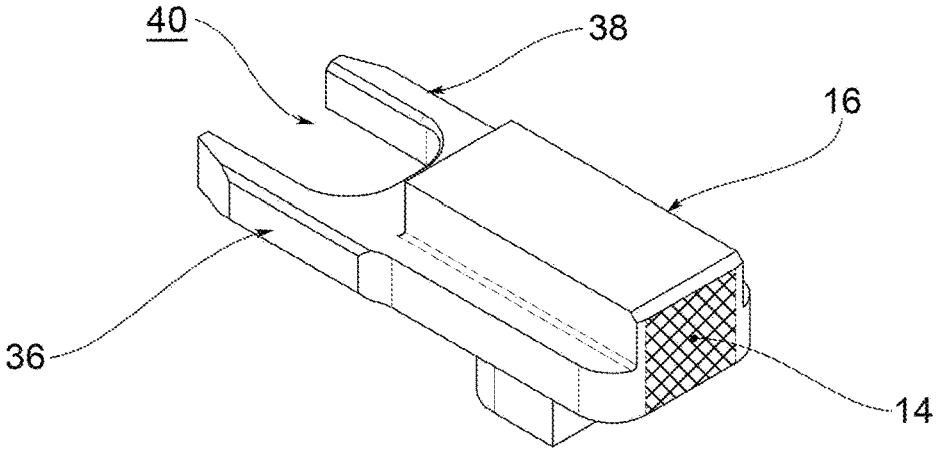
FIG. 3B shows a perspective view of an adjustment member, from an opposite angle with respect to that shown in FIG. 3A.
Figure 4:
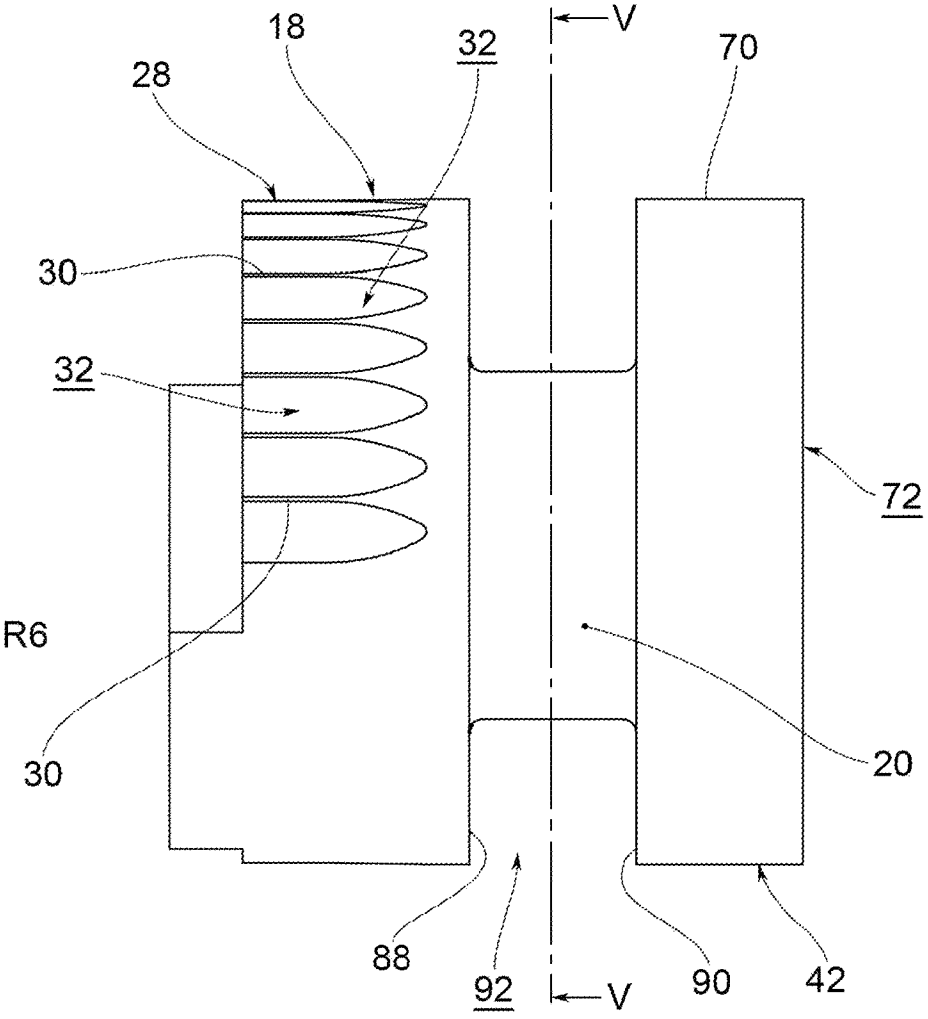
Figure 5:
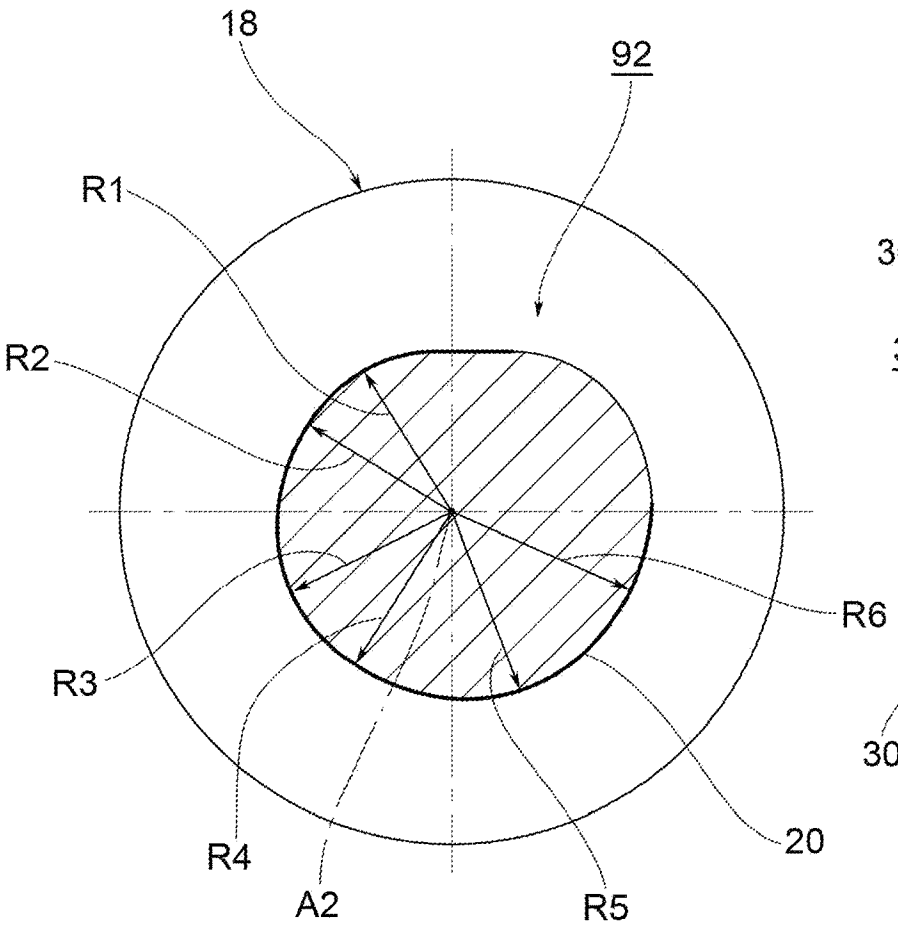
Figure 6:
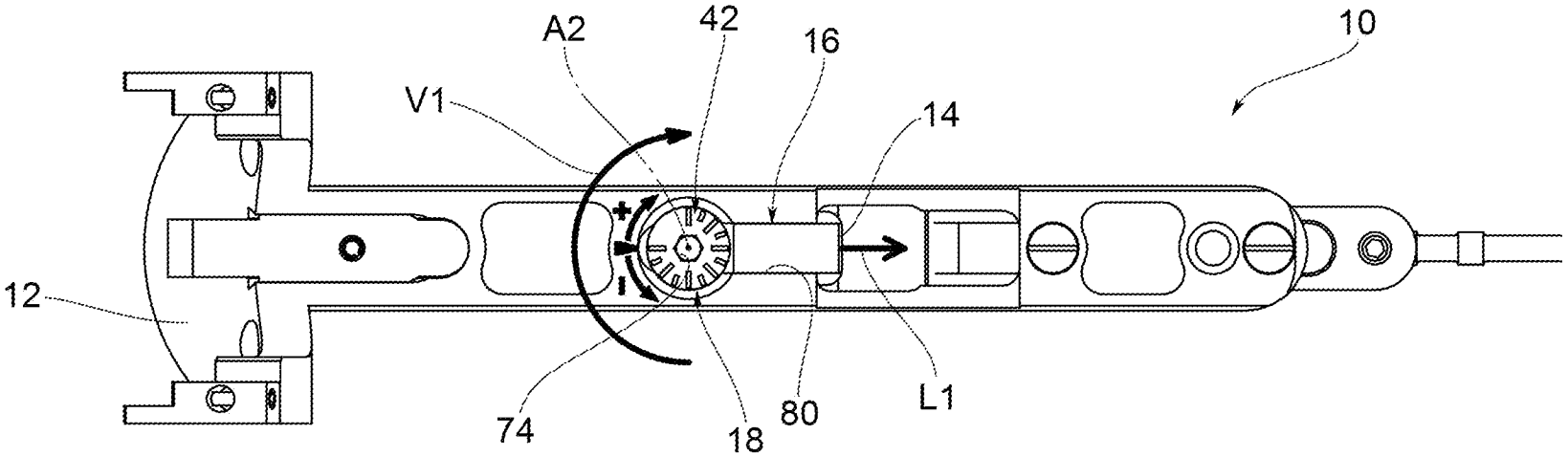
Figure 7:
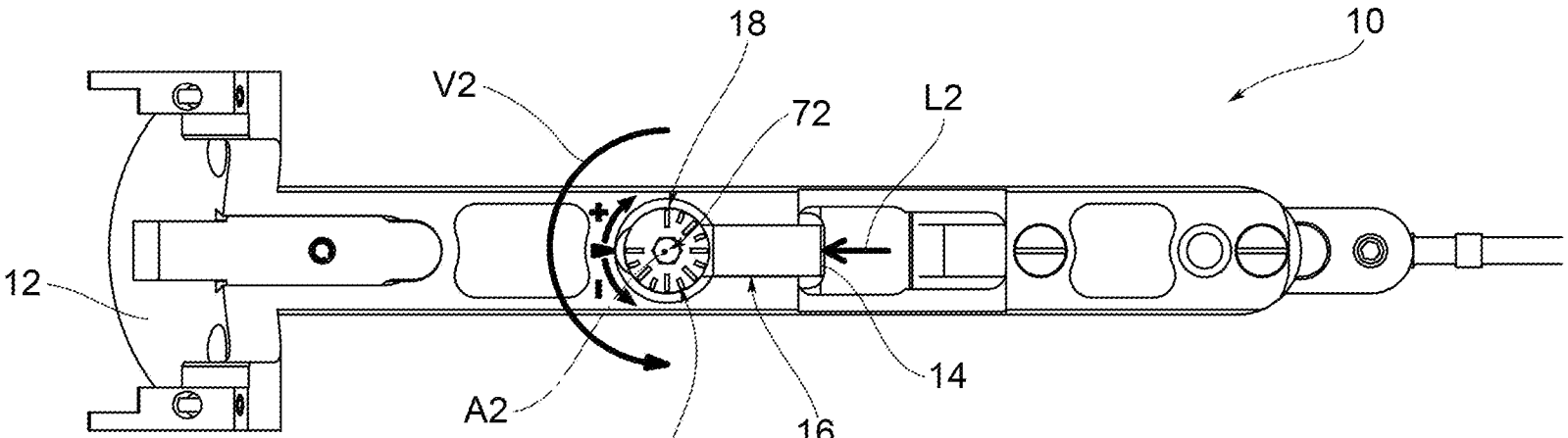
Figure 8:
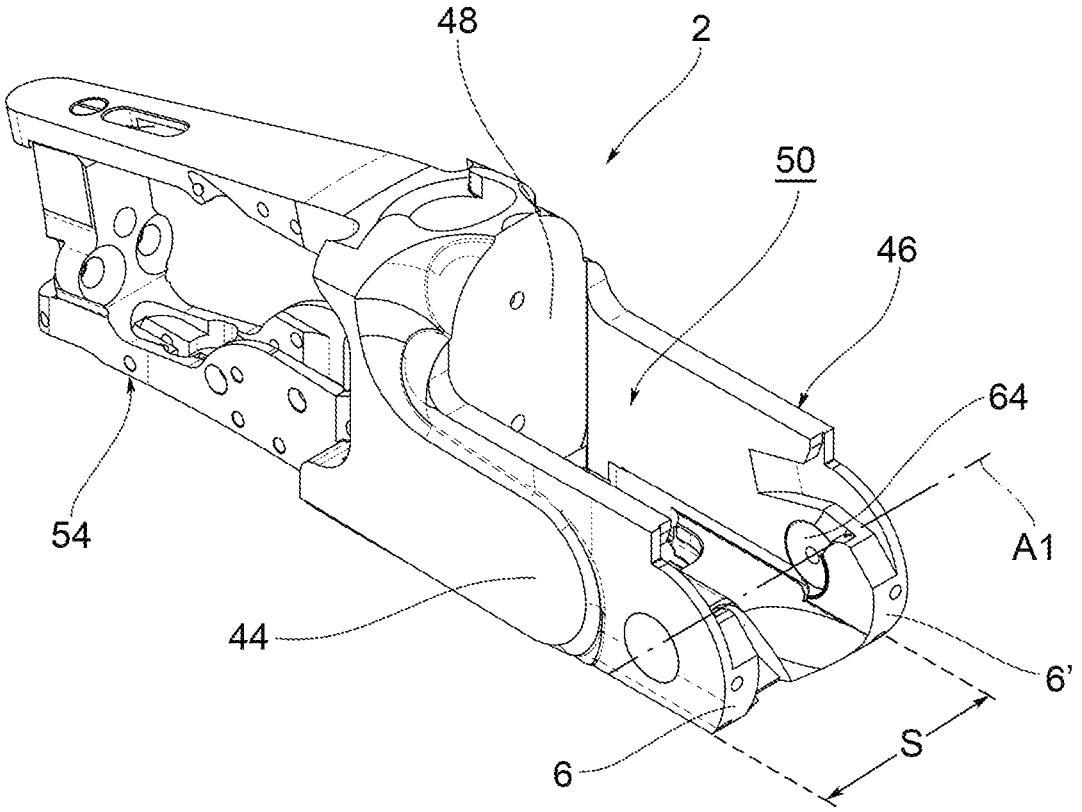
Figure 9:
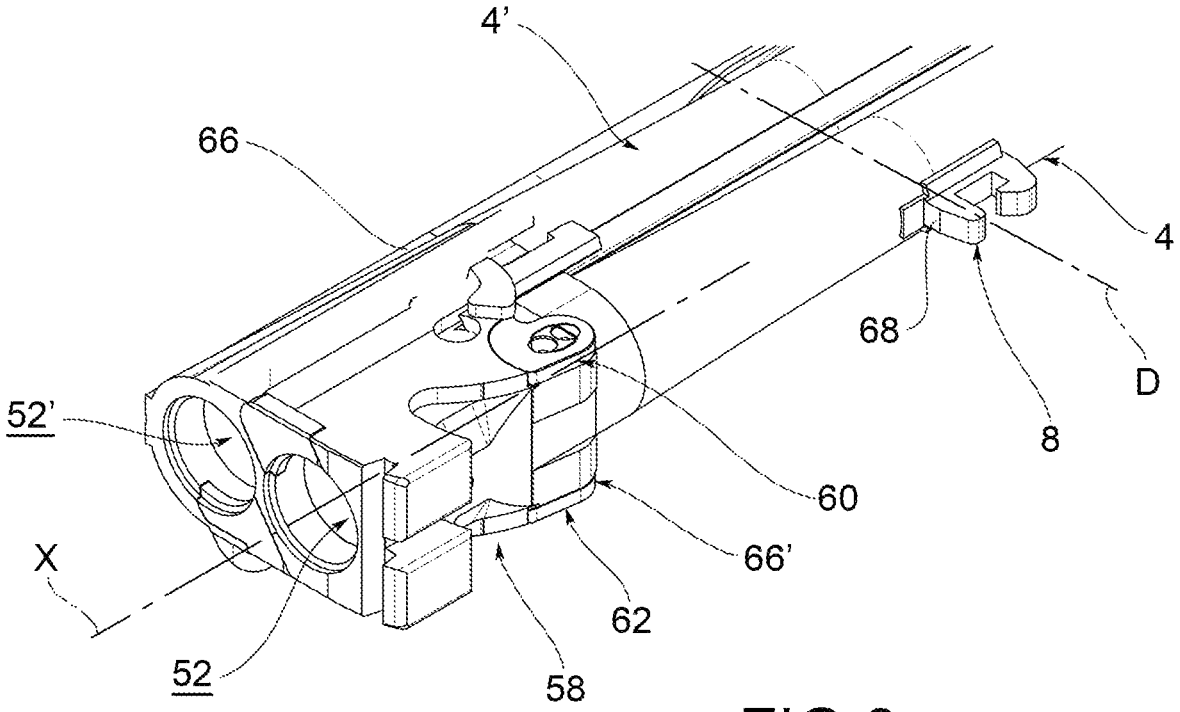

FIGS. 4 and 5 respectively show a lateral view and a sectional view of the maneuvering element shown in FIG. 3A, where the section in FIG. 5 is made along the plane V-V in FIG. 4;

FIGS. 6 and 7 show a top view of the adjustment device in FIG. 1, in various operations for adjusting the resistance;

FIGS. 8 and 9 schematize perspective views of a firearm frame and a pair of barrels, respectively, in which the contact surfaces of the barrel with respect to the frame and of the friction surfaces of the adjustment device with respect to the firearm frame are clearly visible.

With reference to the above figures, reference numeral 1 denotes, as a whole, a firearm comprising a firearm frame 2 which delimits at least one first friction surface 6, 6', at least one barrel 4, 4', and an adjustment device 10 as described below.

According to an embodiment, the firearm frame 2 comprises a pair of side edges 44, 46, which together with an inner surface 48 facing the barrel 4, 4' delimit a frame compartment 50, in which the barrel 4, 4' is inserted in a rotatable manner.

According to an embodiment, the firearm frame 2 delimits a pair of first friction surfaces 6, 6', spaced through a thickness S of the frame 2.

According to an embodiment, the first friction surfaces 6, 6' are identified by the side edges 44, 46, for example frontally or distally thereto.

It is noted that in this description, the expressions "frontal" or "distal" will be used with reference to the positioning or orientation of the components with respect to a longitudinal direction X of the at least one barrel 4. More precisely, "distal" are the components oriented towards a firing mouth of the barrel, while "proximal" are the parts oriented or facing towards a coupling portion 54 of the firearm frame 2 to a stock 56 (the latter for example shown in FIG. 1).

In the embodiments shown, the firearm 1 is a rifle, optionally a combined rifle.

For example, such a rifle could have two barrels 4, 4' side by side or overlapped. The invention should not however be considered limited to such embodiment, provided purely by way of non-limiting example, as in other variants the firearm could comprise a single barrel, or on the contrary, more than two barrels.

According to an embodiment, the at least one barrel develops (specifically: tubularly) around the longitudinal direction X.

According to an embodiment, each barrel 4, 4' proximally delimits a combustion chamber 52, 52' arranged coaxially with the barrel with respect to the longitudinal direction X thereof.

The barrel 4, 4' is mounted to the firearm frame 2 in a rotatable manner (about the rotation axis A1) between a closed configuration and an open configuration (and vice versa) and comprises an abutment appendix 8.

More precisely, in the first one of such configurations, the barrel 4, 4' and the inner surface 48 of the firearm frame 2 cooperate to close at least one combustion chamber 52, 52'. On the contrary, in the second of the above configurations, the barrel 4, 4' (or a barrel sleeve 58 which mechanically groups a plurality of barrels) is spaced from the inner surface 48, whereby the combustion chamber 52, 52' is accessible, for example to load the weapon 1 or to remove the casings of the ammunition already fired.

According to an embodiment, the firearm 1 comprises at least one rotation pin 60, 62 which extends between the firearm frame 2 and the barrel 4, 4' (or between the firearm frame 2 and the sleeve 58) to guide such a barrel (or sleeve) around the rotation axis A1. For example, the embodiments in the figures show a rotation pin 60, 62 with an ellipsoidal or ovoidal section.

In the embodiment shown for example in FIG. 9, there is provided a pair of rotation pins 60, 62 arranged on opposite sides of the firearm 1, in particular facing the side edges 44, 46.

According to an embodiment, the rotation pin 60, 62 is formed integrally with the barrel 4, 4', specifically proximal to the sleeve 58.

According to an embodiment, the rotation pin 60, 62 and the firearm frame 2 lie abutting with each other through complementary sliding surfaces 64, 64', 66, 66' delimited by each, so as to guide the rotations of the barrel 4, 4' (or of the sleeve 58).

According to an embodiment, the abutment appendix 8 is connected to and extends from the barrel 4, 4' along a direction D substantially orthogonal to the longitudinal direction X.

According to an embodiment, the abutment appendix 8 is irremovably fixed to the barrel 4, 4', for example by means of one or more welds.

According to an embodiment, the abutment appendix 8 is integral in rotation to the barrel 4, 4'.

In the embodiments shown, the longitudinal direction X of the barrel 4, 4' and the relative rotation axis A1 with respect to the firearm frame 2 are incident to each other (preferably orthogonal), at least in projection.

The adjustment device 10 comprises at least a second friction surface 12 placed in a sliding contact with the first friction surface 6, 6' to oppose a resistance to the rotation of the barrel 4, 4' between the above configurations, a contact surface 14 with the abutment appendix 8, an adjustment member 16, and a maneuvering element 18.

According to an embodiment, the adjustment device 10 comprises a single second friction surface 12, which develops, for example, in the shape of a half-moon.

According to an embodiment, one or the plurality of second friction surfaces 12 has a concave shape facing the firearm frame 2.

According to an embodiment, one or the plurality of first friction surfaces 6, 6' have a convex shape facing the adjustment device 10, and more precisely the at least one second friction surface 12.

According to an embodiment, the adjustment device 10 comprises a device frame or body 24 which extends along the longitudinal direction X.

According to an embodiment, the device body 24 proximally delimits the second friction surface 12 or the plurality thereof.

The adjustment member 16 is movable longitudinally (along directions L1, L2, schematized in FIGS. 6 and 7, and in particular it is movable with respect to the device body 24) to modify a relative distance between the second friction surface 12 and the contact surface 14, thereby adjusting the sliding friction between said friction surfaces 6, 6', 12, and therefore said resistance.

In fact, a movement of the adjustment member 16 along a distal longitudinal direction L1 against the abutment appendix 8 will cause a counter reaction of the second friction surface 12, which then will press with greater force on the first friction surface 6, 6' (thus increasing the resistance to rotation).

On the contrary, a movement of the adjustment member 16 along a proximal longitudinal direction L2 against the abutment appendix 8 will cause a counter reaction of the second friction surface 12, which then will press with less force on the first friction surface 6, 6' (thus reducing the resistance to rotation).

In fact, it should be noted that such an abutment appendix serves—as its name suggests—as a stop or as a reference for the movement of the second friction surface 12, and for changing the distance between the latter with respect to the contact surface 14.

According to an embodiment, the abutment appendix 8 delimits (for example proximally) at least a second contact surface 68 intended to abut against the contact surface 14.

According to an embodiment, the adjustment member 16 is longitudinally translatable.

According to an embodiment, the adjustment member 16 delimits the contact surface 14, for example in a frontal or distal position.

The maneuvering element 18 is rotatable (about the rotation axis A2) in discrete adjustment positions, and interacts with the adjustment member 16 to move it (for example to make it translate) by a constant pitch at each angularly adjacent adjustment position.

It follows that, innovatively, the maneuvering element 18 is rotatable in a series of separate angular adjustment positions (for example with a step adjustment), so that the adjustment member 16 is moved by the same extent or pitch in all the adjustment positions.

In other words, the movements of the maneuvering element 18 always cause equal movements of the adjustment member 16 (in the proximal direction or in the distal direction) in any angular position of the maneuvering element.

According to an embodiment, each constant step is of the order of one tenth or one hundredth of a millimetre.

According to an embodiment, the maneuvering element 18 comprises a rotation body, for example with a variable section along the rotation axis A2 thereof.

According to an embodiment, the maneuvering element 18 interacts with the adjustment member 16 by means of a cam surface or profile 20 of the maneuvering element 18.

According to an embodiment, the cam surface or profile 20 of the maneuvering element 18 is placed abutting an opposed surface 86 (for example facing proximally) delimited by the adjustment member 16.

According to an embodiment, the cam surface or profile 20 and the opposite surface 86 lie in direct contact with each other.

According to an embodiment, the cam surface or profile 20 of the maneuvering element 18 develops around the rotation axis A2 of such an element 18 with a plurality of mutually different curvature radii R1-R6, optionally eccentric, for example, tangent to each other.

According to an embodiment, the curvature radii R1-R6 are progressively increasing in a direction of rotation V1 of the maneuvering element 18 (see for example FIG. 6) which is capable of increasing the resistance to rotation of the barrel 4, 4'.

According to an embodiment, the curvature radii R1-R6 are progressively decreasing in a direction of rotation V2 of the maneuvering element 18 (see for example FIG. 7) which is capable of reducing the resistance to rotation of the barrel 4, 4'.

According to an embodiment, the maneuvering element is movable by the action of the user's hands alone (that is to say, without the need of using adjustment tools). In this regard, according to a variant not shown, an element head 42 of such an element 18 may comprise a gripping position, for example projecting, optionally comprising a diametric fin.

According to an embodiment, the maneuvering element 18 comprises an element head 42 which is counter-shaped to an adjustment tool (not shown), in order to move said element 18 into the discrete adjustment positions.

According to an embodiment, the element head 42 may be shaped with a polygonal section (e.g. hexagonal or octagonal).

According to an embodiment, the element head 42 may be shaped along a peripheral edge 70 thereof, and/or may comprise a seat or a head compartment 72 configured to accommodate the adjustment tool, the inner walls 74 delimiting such a seat or compartment 72 being shaped in the aforesaid manner. By way of example, the adjustment tool may include an Allen key or a spanner.

According to an embodiment, maneuvering element 18 has an irreversible rotation.

It should be noted that in this description, the term "irreversible" means an inversely invariable rotation by the opposing forces exerted by the adjustment member 16 in the normal conditions of use of such a firearm 1.

According to an embodiment, such an irreversible rotation is caused by the special cam profile discussed above.

According to an embodiment, such an irreversible rotation is caused by the locking means 22 discussed below.

According to an embodiment, the constant pitch is about 0.01-0.1 mm.

According to an embodiment, the maximum longitudinal movement of the adjustment member 16 between limit adjustment positions is equal to or less than 5.0 mm. For example, the maximum longitudinal movement of the adjustment member 16 between limit adjustment positions is in the range of 0.5-3.0 mm.

According to an embodiment, the adjustment positions are angularly equidistant around the maneuvering element 18.

According to an embodiment, the adjustment positions are angularly equidistant by about 8°-15°, for example 10°-12°.

According to an embodiment, the adjustment device 10 comprises locking means 22 of the maneuvering 18 in the discrete adjustment positions.

According to an embodiment, the locking means 22 are of the reversible snap type.

According to an embodiment (not shown), the locking means may comprise a spring with a radial tooth—with respect to the axis A2—configured to engage a plurality of radial seats complementary to such a tooth, delimited by the maneuvering element, for example in a peripheral position to the latter.

According to an embodiment, the adjustment device 10 comprises a device body 24 which delimits an element seat 26 for at least partially housing the maneuvering element 18.

According to an embodiment, the element seat 26 comprises a cavity passing through a thickness of the device body 24.

According to an embodiment, the device body 24 delimits an element seat 26, a member seat 76 and an appendix seat 78, for example longitudinally side by side, and advantageously arranged in that order along the longitudinal direction X in the distal direction.

Specifically, the member seat 76 is configured to accommodate the adjustment member 16 in a movable or translatable manner. Furthermore, the appendix seat 78 is configured to at least partially house the abutment appendix 8.

According to an embodiment, the member seat 76 communicates with the appendix seat 78, so that the contact surface 14 can come into contact with the abutment appendix 8 (and in particular the second contact surface 68 of such an appendix 8).

According to an embodiment, the seat walls 80, 82 delimiting the member seat 76 have a free cross-section configured for shape-coupling with a cross-section of the adjustment member 16, so as to guide it in the different longitudinal movements.

According to an embodiment, the adjustment device 10 comprises a locking element 28 of the locking means 22 received partly in the device body 24 and constantly forced towards the element seat 26 so as to intercept an adjustment periphery 28 of the maneuvering element 18.

According to an embodiment, a cross section—with respect to the rotation axis A2 of the maneuvering element 18—of the adjustment periphery 28 is shaped with alternating ridges 30 and depressions 32.

According to an embodiment, the locking element 28 (for example an optionally pointed distal head 84 of such an element 28) is configured to engage such depressions 32 in each adjustment position.

More specifically, the locking element 28 is constantly forced in abutment of the control periphery 28 by elastic means 34 of the adjustment device 10.

According to an embodiment, the maneuvering element 18 is longitudinally movable or translatable L1, L2 with the second friction surface 12 so as to exert a lower or greater pressure on the first friction surface 6, 6'.

According to an embodiment, the adjustment member 16 and the maneuvering element 18 are geometrically coupled.

More precisely, the adjustment member 16 comprises a pair of lateral arms 36, 38 which delimit a guide space 40 between them in which at least a cam surface or profile 20 of the maneuvering element 18 is housed.

According to an embodiment, the cam surface or profile 20 is formed radially in undercut (with reference to the rotation axis A2).

In other words, a variant provides that the cam surface or profile 20 is axially delimited by a pair of annular surfaces 88, 90, projecting radially outwardly with respect to the surface or profile 20, to delimit a peripheral recess 92 at least partly housing the pair of side arms 36, 38.

The aforesaid objects are also solved by an adjustment device 10 of a firearm.

Since in a variant of such a device it is associable to a firearm 1 as described above, advantageous embodiments of such a device may include any of the foregoing features, even if this is not expressly indicated.

The adjustment device 10 comprises at least a second friction surface 12 configured to be placed in a sliding contact with a first friction surface 6, 6' of the firearm frame 2 to oppose a resistance to the rotation of the barrel 4, 4' between a closed configuration and an open configuration, a contact surface 14 with the abutment appendix 8, an adjustment member 16, longitudinally movable L1, L2 for modifying a relative distance between the second friction surface 12 and the contact surface 14, thereby adjusting the sliding friction between such friction surfaces 6, 6', 12, and therefore the above resistance, and a maneuvering element 18 rotatable in discrete adjustment positions, interacting with the adjustment member 16 to move it by a constant pitch at each angularly adjacent adjustment position.

Innovatively, the firearm and the device object of the present invention allow solving the drawbacks related to the prior art.

More precisely, the described adjustment device allows selecting a plurality of discrete adjustment positions of the barrel rotation resistance, so that the firearm may be customized at any time, by the manufacturer or by the end user.

Advantageously, the firearm object of the present invention allows precise adjustments also by non-specialists.

Advantageously, the firearm object of the present invention has an adjustment device designed not to lose its own adjustments, for example due to firing forces or following accidental drops of the firearm.

Advantageously, the firearm object of the present invention is constructively simple, therefore suitable to be produced in a cost-effective manner.

Advantageously, the geometrical couplings discussed above are suitable for ensuring reliable and repeated operation of the firearm and of the adjustment device.

Advantageously, the firearm object of the present invention is configured to distribute the forces homogeneously along the surfaces provided for this purpose, so as to reduce the amount of mechanical stresses to which the firearm is constantly subjected.

Advantageously, the described kinematism allows solving in a simple manner the problem of producing constant advancements or retractions in any angular position of the maneuvering element.

Advantageously, the device object of the present invention allows making precise and small adjustments, of the order of the fraction of a millimetre.

Advantageously, the device object of the present invention allows a step adjustment which, from the point of view of the person making the adjustments, gives an unparalleled sensitivity with regard to the necessary adjustments.

Advantageously, the device of the present invention advances with a constant pitch allows the resistance to be adjusted progressively, and in a certain sense predictably.

Advantageously, the device object of the present invention may be operated with a tool, or with the sole action of the hands.

A man skilled in the art may make several changes or replacements of elements with other functionally equivalent ones to the embodiments of the above firearm and adjustment device and gun in order to meet specific needs.

Also such variants are included within the scope of protection as defined by the following claims.

Moreover, each variant described as belonging to a possible embodiment may be implemented independently of the other variants described.

The invention claimed is:

1. An adjustment device (10) for a firearm (1), wherein said firearm (1) comprises:

a first support portion (2) delimiting at least one first friction surface (6, 6'); and at least one barrel (4, 4'), mounted to said support portion (2) in a rotatable manner (A1) between opening and closing configurations and comprising an abutment appendix (8); and wherein said adjustment device (10) comprises:

i) at least a second friction surface (12) configured to be placed in a sliding contact with the first friction surface (6, 6') to oppose a resistance to the rotation of the barrel (4, 4') between said configurations;

ii) a contact surface (14) with the abutment appendix (8);

iii) an adjustment member (16), movable longitudinally (L1, L2) to modify a relative distance between the second friction surface (12) and the contact surface (14), thereby adjusting the sliding friction between said friction surfaces (6, 6', 12), and therefore said resistance;

iv) a maneuvering element (18) rotatable in discrete adjustment positions, interacting with the adjustment member (16) to move it by a constant pitch at each angularly adjacent adjustment position.

2. The adjustment device (10) according to claim 1, wherein the maneuvering element (18) interacts with the adjustment member (16) through a cam surface or a cam profile (20) of the maneuvering element (18), which extends around the rotation axis (A2) of said element (18) with a plurality of mutually different curvature radii (R1-R6), which are eccentric and tangential to each other.

3. The adjustment device (10) according to claim 2, wherein the curvature radii (R1-R6) increase progressively in a direction of rotation (V1) of the maneuvering element (18) which is capable of increasing the resistance to the rotation of the barrel (4, 4'), and/or wherein the curvature radii (R1-R6) decrease progressively in a direction of rotation (V2) of the maneuvering element (18) capable of reducing the resistance to rotation of the barrel (4, 4').

4. The adjustment device (10) according to claim 1, wherein the maneuvering element (18) has an irreversible rotation, i.e. not mutable reversibly by the opposing forces exerted by the adjustment member (16) in normal use conditions of said firearm (1).

5. The adjustment device (10) according to claim 1, wherein the constant pitch is 0.01-0.1 mm, and/or wherein the maximum longitudinal movement of the adjustment member (16) between limit adjustment positions is equal to or smaller than 5.0 mm.

6. The adjustment device (10) according to claim 1, wherein the adjustment positions are angularly equidistant around the maneuvering element (18).

7. The adjustment device (10) according to claim 1, wherein the adjustment device (10) comprises locking means (22) of the maneuvering element (18) in the discrete adjustment positions, said means (22) being of the reversible snap-action type.

8. The adjustment device (10) according to claim 7 comprising a device body (24) which delimits an element seat (26) for at least partial housing of the maneuvering element (18), and comprising a locking element (28) of the locking means (22) received partly in the device body (24) and constantly forced towards the element seat (26) so as to intercept an adjustment periphery (28) of the maneuvering element (18).

9. The adjustment device (10) according to claim 8, wherein a transverse section—with respect to the rotation axis (A2) of the maneuvering element (18)—of the adjustment periphery (28) is shaped with alternating ridges (30) and depressions (32), where the locking element (28) is configured to engage said depressions (32) in each adjustment position being constantly forced in abutment against the adjustment periphery (28) by elastic means (34) of the adjustment device (10).

10. The adjustment device (10) according claim 1, wherein the adjustment member (16) delimits the contact surface (14) in an optionally frontal position, and wherein the maneuvering element (18) is movable longitudinally (L1, L2) with the second friction surface (12) so as to exert a lower or greater pressure on the first friction surface (6, 6').

11. The adjustment device (10) according to claim 1, wherein the adjustment member (16) and the maneuvering element (18) are geometrically coupled, the adjustment member (16) comprising a pair of lateral arms (36, 38) which delimit a guide space (40) between them wherein is housed at least part of the cam surface or cam profile (20) of the maneuvering element (18), for example made radially in undercut.

12. The adjustment device (10) according to claim 1, wherein the maneuvering element (18) comprises an element head (42) counter-shaped with an adjustment tool, for example with a polygonal section, in order to move said element (18) in the discrete adjustment positions.

13. A firearm (1) comprising:

a first support portion (2) delimiting at least one first friction surface (6, 6');

least two side-by-side or superimposed barrels (4, 4'), mounted to said first support portion (2) in a rotatable manner (A1) between opening and closing configurations and comprising an abutment appendix (8); and an adjustment device (10) comprising:

i) at least a second friction surface (12) configured to be placed in a sliding contact with the first friction surface (6, 6') to oppose a resistance to the rotation of the barrel (4, 4') between said configurations;

ii) a contact surface (14) with the abutment appendix (8);

iii) an adjustment member (16), movable longitudinally (L1, L2) to modify a relative distance between the second friction surface (12) and the contact surface (14), thereby adjusting the sliding friction between said friction surfaces (6, 6', 12), and therefore said resistance;

iv) a maneuvering element (18) rotatable in discrete adjustment positions, interacting with the adjustment member (16) to move it by a constant pitch at each angularly adjacent adjustment position.

* * * * *